US005440102A

United States Patent [19]

Pena

[11] Patent Number: 5,440,102

[45] Date of Patent: Aug. 8, 1995

[54] SYSTEM FOR THE PROTECTION OF LUGGAGE

[76] Inventor: Norberto C. Pena, 8, Concha Espina, 28036 Madrid, Spain

[21] Appl. No.: 205,585

[22] Filed: Mar. 3, 1994

[51] Int. Cl.[6] ..... F27D 7/04; F27B 9/06

[52] U.S. Cl. ..... 219/388; 219/400

[58] Field of Search ..... 219/388, 400; 126/21 A, 126/21 R

[56] References Cited

U.S. PATENT DOCUMENTS

| | | | |
|---|---|---|---|
| 3,156,812 | 11/1964 | Forman et al. | 219/388 |
| 3,399,506 | 9/1968 | Howe | 219/388 |
| 3,502,020 | 3/1970 | Bressickello | 219/388 |
| 3,513,293 | 5/1970 | Beck | 219/388 |
| 3,578,747 | 5/1971 | Schramm | 219/388 |
| 3,717,939 | 2/1973 | Mitchell | 219/388 |
| 4,389,562 | 6/1983 | Chaudoir | 219/388 |
| 4,538,363 | 9/1985 | Zagoroff | 219/388 |
| 4,616,123 | 10/1986 | Zagoroff | 219/388 |
| 5,062,217 | 11/1991 | Tolson | 219/388 |

*Primary Examiner*—Teresa J. Walberg
*Attorney, Agent, or Firm*—Kuhn and Muller

[57] ABSTRACT

A system is provided for the protection of luggage, based on the application by thermic effects of a polyethylene retractile material around the luggage in order to obtain an external protection against damage produced by possible improper handling. It includes an oven having top, lateral and bottom walls and inside the oven a set of electric resistances, a fan, a thermostat and on the front side a curtain made of an insulating material covering the entrance to oven. The system presents a horizontal conveyor to introduce the luggage into the oven or taking it out. The conveyor is provided with a proximity detector and the system has an electric board to command and control all automatic functions of the system. The ceiling, bottom and lateral walls of the oven are built by means of a structure with a double layer of metal plates and between them an insulating material is placed, the thickness of this being bigger in the ceiling than in the lateral walls and in the lateral walls bigger than in the bottom wall.

10 Claims, 4 Drawing Sheets

SYSTEM FOR THE PROTECTION OF LUGGAGE

FIELD OF THE INVENTION

The present invention refers to a system for the protection of luggage, which is based on the application by thermic effect of a polyethylene retractile material wrap around the luggage in order to obtain an external protection against scratches, stains, humidity, improper handling and possible larceny.

BACKGROUND OF THE INVENTION

As it is well known, when using public transportation, luggage or any other package of large size has to be consigned for storage.

In airports, when checking and putting the luggage on board, labels and any other signals are stuck onto the luggage suitcases, which stick on labels later are difficult to take off from the luggage.

Also, the luggage is placed on automatic conveyors, running through a long way to the airplane storage room. This type of conveyor sometimes produces damage to the luggage, such as scrapes, stains, etc.

Also, public buses have a compartment to store the luggage, but these compartments are limited in space and suitcases have to be placed piled up, consequently with the possibility of damage to the luggage suitcases.

Up to now, no system to solve above-mentioned problems is known, so, the system for the protection of luggage, the subject of the present invention can be considered as an innovation.

OBJECTS OF THE INVENTION

This system protects the luggage by wrapping it with a shrink wrap of transparent plastic, covering the total surface of luggage. At the same time, this allows a user to place on it any label or signal for identification.

This wrapping protects the luggage against scratches or any other damage that may suffer; such as scrapes, collisions, etc. Once the luggage arrives its intended destination, this plastic cover can be taken off, easily letting the luggage to be free of identifying signals, labels or damages.

SUMMARY OF THE INVENTION

The system for protection of luggage here recognized, includes therefore the use of special shrinkable plastic bags wherein the luggage is put into. This shrinkable plastic material is exposed to a slight heat for a short period of time, and undergoes a retraction in size, so that the plastic material when shrunk causes the luggage to get totally covered and closed.

To achieve this thermic effect, there has been designed an oven, specially made for this purpose. The oven consists of a rectangular chamber, of which the ceiling, bottom and lateral walls constitute a double layer of metal plates, and between them, an insulating material is placed, such as fiberglass.

The thickness of this insulating material is bigger in the ceiling than in the lateral walls, and is bigger in the lateral walls than in the bottom. This is due to the fact that as the hot air has the tendency of ascension, there is the possibility of losing some of the heat in the upper parts of the oven.

The front part of the oven is open to get the luggage in. This front entrance has a curtain specially made with an insulating material to avoid as much as possible the escape of hot air and to maintain the temperature inside.

The rear part of the oven is closed, like the lateral walls or it can be open with curtains for an outlet, oppositely located from the front entrance, for the luggage when a higher production of luggage units to be wrapped is required.

The necessary inside temperature for retraction of the shrinkable plastic material upon the luggage is produced by installing a set of electric resistors with given resistances, which are commanded from an electric board, in connection with a thermostat, to fix and maintain the adequate temperature, such as 200–260 Deg. C, depending on the thickness of the plastic and the time of luggage placement inside the oven, such as 15 to 45 seconds. In order to obtain an homogeneous thermo-retroaction of the plastic wrap against all parts of the plastic wrap material covering the luggage, a set of fans are installed inside the oven, so that hot air is moving constantly throughout the oven.

To introduce luggage, this system has two mechanical options.

First, for a conveyor with displacement of luggage, in this case, the conveyor consists of a fixed structure with a mechanism for horizontal movement of the luggage into and out of the oven by means of a steel net band or metallic rod/tube line, forming a baggage rack for the inlet and outlet of luggage.

The second option consists of a mobile conveyor where the conveyor of the luggage is movable through the inlet and outlet of the oven by the same door.

In both options, each conveyor has a proximity detector, situated at the beginning for the correct placement of luggage to be duly wrapped.

Once the luggage is duly placed on the conveyor, it is introduced in the oven by pushing a button on the electric board.

The temperature inside the oven is fixed in advance and so is the necessary time for retraction of the plastic material upon the luggage. When luggage is ready, the conveyor moves out automatically forward or backward to take the luggage out of the oven.

DESCRIPTION OF THE DRAWINGS

For a better comprehension of the present invention, reference is made to the drawings attached, in which.

DETAILED DESCRIPTION OF THE PRESENT INVENTION

In order to avoid repetitions, the present invention includes a system with an oven with one only access for both inlet and outlets with respective options of the type of conveyor used. It is noted that the present invention does not exclude the protection of luggage in case the oven has two accesses, one for entrance and another one for exit of the luggage.

Figure 1:
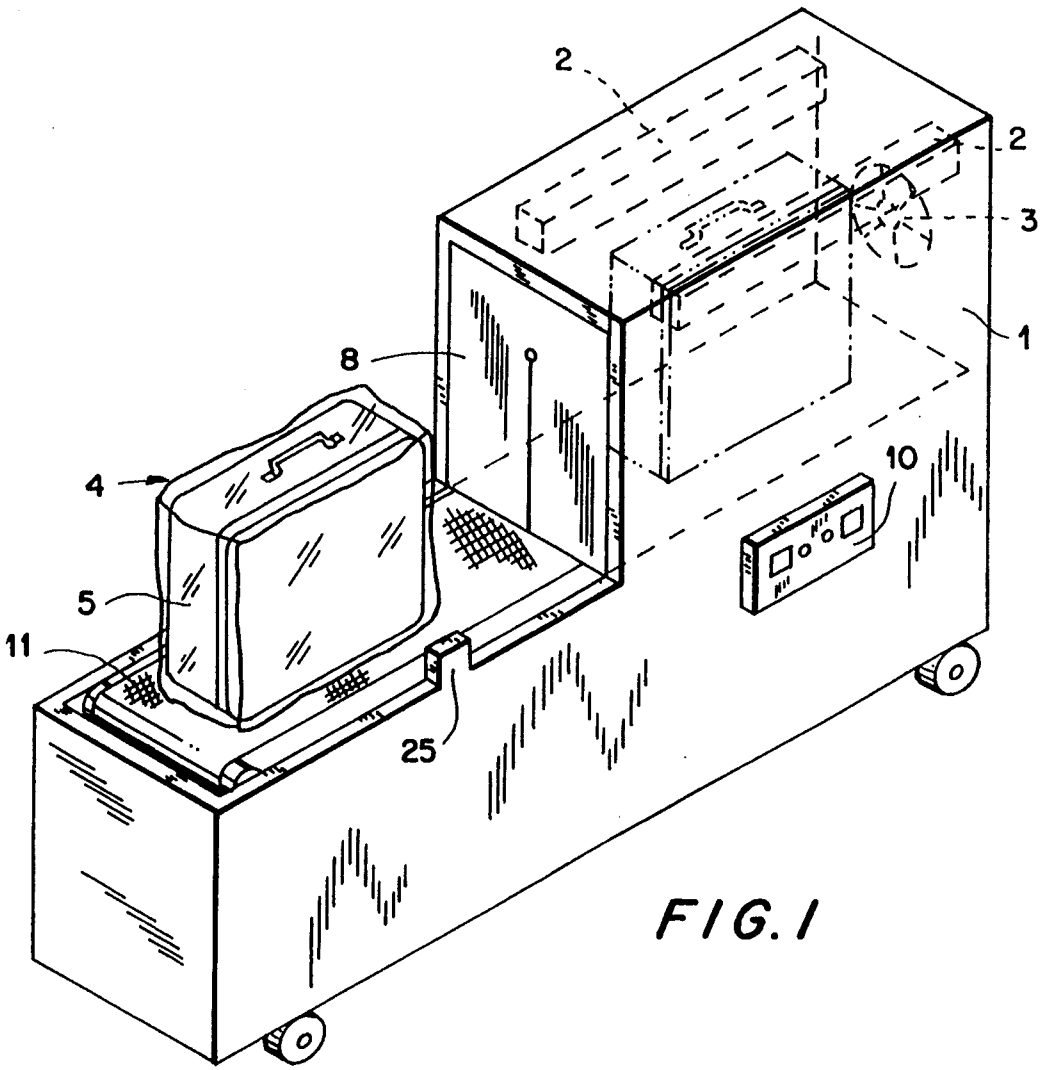
FIG. 1 is perspective view of the luggage protection machine of the present invention.

As shown in FIG. 1, luggage 5 enters oven through flexible curtain 8 in an upright position, with the handle facing up.

Figure 2:
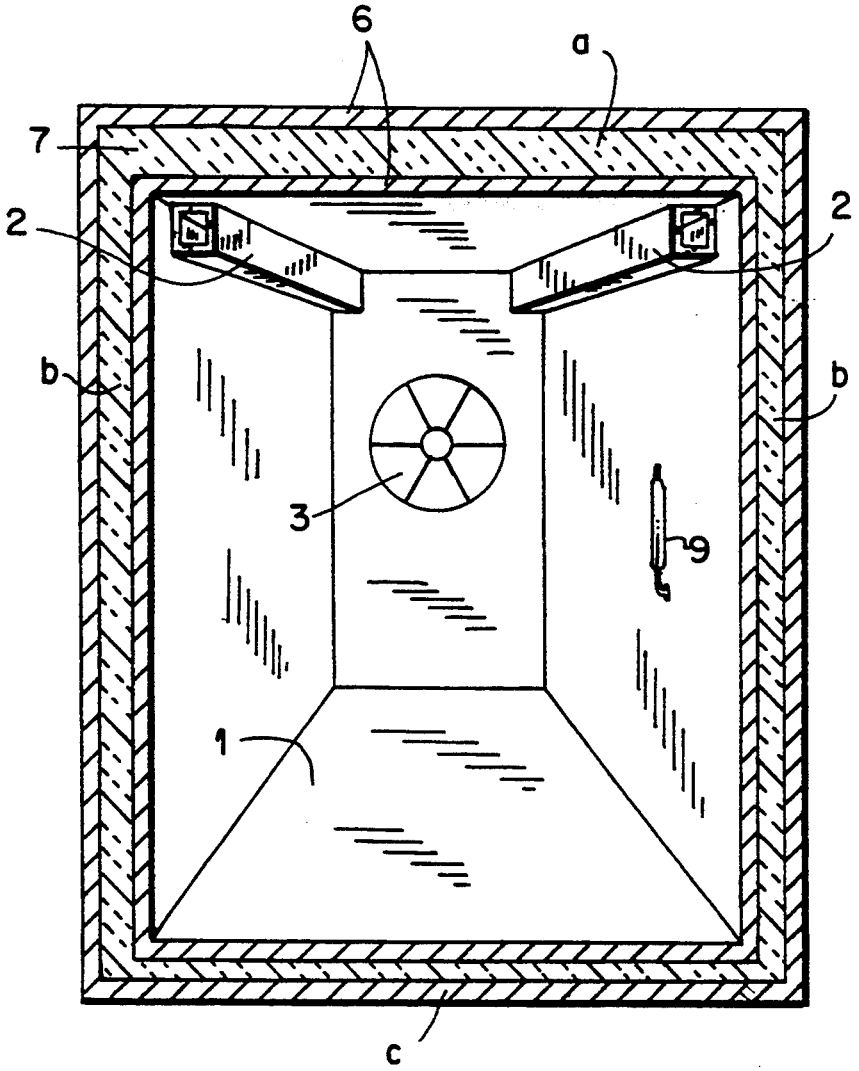
FIG. 2 is a cross-sectional front view of the oven portion of the machine as in FIG. 1.

As shown in FIGS. 1 and 2, the system for protection of luggage includes one oven (1). Inside this oven (1), there are a set of electric resistances (2) to heat the air inside the oven (1). A fan (3) also situated in the oven (1) moves the air in order to get an homogeneous temperature inside the oven (1) necessary for the retraction of shrink film plastic bag (4) to be wrapped around the luggage (5).

As shown in FIG. 2, the ceiling, bottom and lateral walls of the oven (1) constitute a double layer of metal plates (6) and between them, there is placed an insulating material (7) such as fiberglass. The thickness of this insulating material (7), and so the distance between the walls (6), is bigger in the ceiling (a) of the oven (1) than in the lateral walls (b), and in the lateral walls, the insulation is bigger than in the bottom (c), to accommodate larger heat insulation requirements as heat ascends upward within oven (1).

The front part (8) of the oven (1) is used as entrance and exit of luggage. This front part (8) is covered by a curtain made also of an insulating material to avoid loss of temperature inside the oven (1).

The temperature inside the oven (1) is controlled by a thermostat (9) in connection with an electric board (10) to command and control, so that inside temperature is kept at the preferred value.

From the electric board (10) are commanded and controlled all automatic functions of the system.

Figure 3:
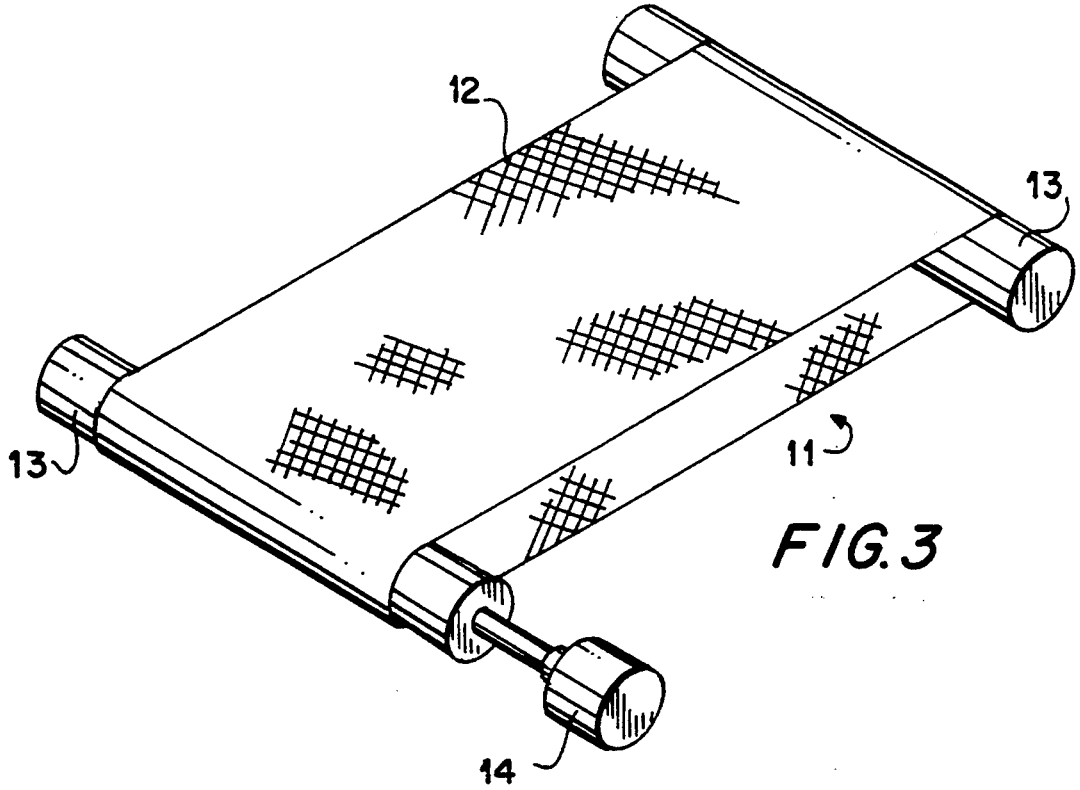
FIG. 3 is a perspective view of a conveyor by means of a continuous band for the machine as in FIG. 1.
Figure 4:
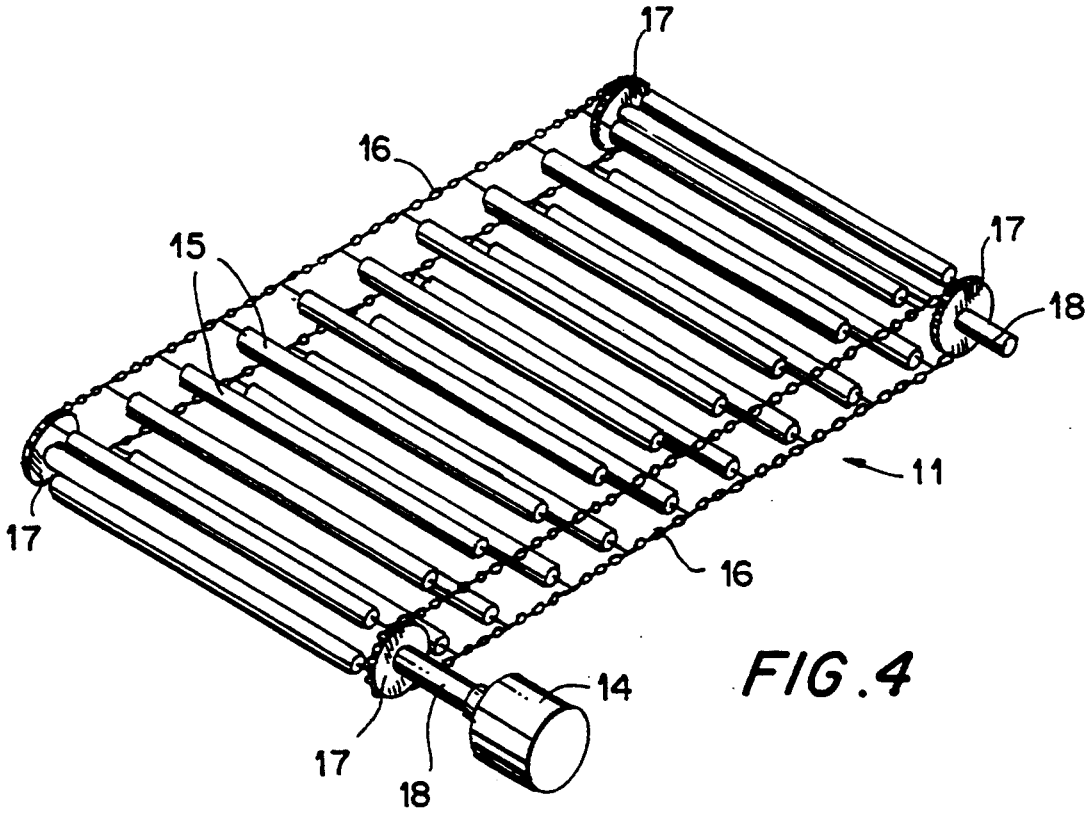
FIG. 4 is a perspective view of a conveyor by means of metal bars of the machine as in FIG. 1.

As it has been described before, the mechanism of conveyance for luggage in and out of the oven (1), can be built by different ways, manual or automatic, in this matter there are two options:

In a first option, one fixed conveyor (11), as shown in see FIG. 3, transports the luggage on a continuous horizontal band (12), made of a heat resisting material such as F.I metal netting, moved by two rollers (13) which are driven by a motor-reducer (14). In this first option, instead of the above-mentioned continuous band, there can be used a continuous line, as shown in FIG. 4, composed of a tubular structure (15), heat resisting, placed in parallel and each one fixed to both metallic chains (16). Each chain (16) is mounted on two driving pinions (17) which turn around two axles (18), moved by a motor-reducer (14).

Figure 5:
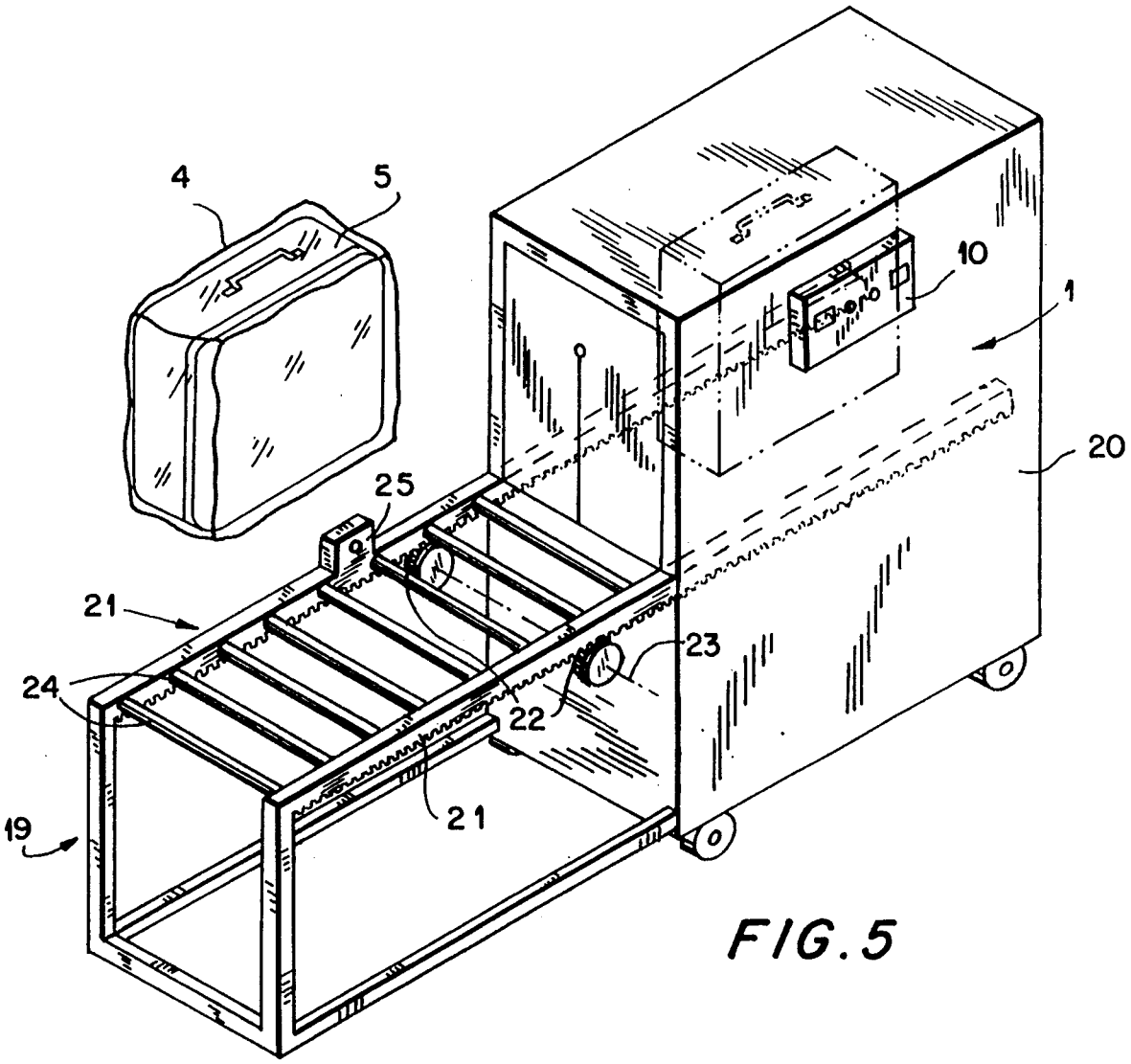
FIG. 5 is a perspective view of an alternate embodiment for a machine for protection of luggage built with a mobile conveyor.

In a second option, as shown in FIG. 5, the system consists of a mobile conveyor (19), where the luggage (5) is placed duly wrapped with the shrink plastic bag (4). The luggage stays without motion upon the conveyor (19), but the conveyor (19) is horizontally displaced in and out of the cabins (20), introducing or taking out the luggage (4) in or out of the oven (1).

As shown in FIG. 5, this conveyor (19) is composed of a rectangular hollow structure having horizontal upper corners (21) which are shaped as two rack rails with cogs looking down. These rack rails are engaged with two pinions or cog wheels (22).

These pinions (22) are coupled by a central shaft (23) which facilitates moving the pinions (22) turning in the same direction of this common shaft (23), driven by a motor-reducer (not shown in FIG. 5). This conveyor if formed by a tubular structure, with a grating shape (21,) where luggage is placed made of a heat resisting material and duly connected to the rack rails (24).

Both options of conveyors hereinabove described, have proximity detectors (25) for the correct placement of luggage. These detectors are electrically connected to the command and control board (10). Once the luggage is placed on the conveyor, the proximity detector (25) sends a signal to the control board (10) and the electric motor is actuated, taking the luggage (4) into the oven (1).

To take the luggage (4) into the oven (1), it is necessary to push a button placed over the control board (10).

It must be pointed out that in second option, the conveyor remains on standby inside the oven and the luggage comes out automatically.

After the aforementioned description, it is noted that it is possible to introduce changes in shape, materials and position, whenever these changes, do not differ substantially the characteristics of this invention, as per the following claims.

What is claimed is:

1. A system for the protection of luggage, based on the application by thermic effect of a polyethylene retractile material around the luggage in order to obtain an external protection against damage produced by possible improper handling, comprising in combination an upright luggage article, said luggage article having a handle on a top edge thereof, an oven, said oven having inside a set of electric resistances, a fan, a thermostat and on the front side of said oven a flexible curtain said flexible curtain being made of an insulating material, said flexible curtain covering an entrance to said oven; said system further including a horizontal conveyor to introduce said luggage article into said oven and to take said luggage article out, said conveyor provided with a proximity detector, said system having an electric board to command and control all automatic functions of said system.

2. The system for the protection of luggage as in claim 1, comprising said oven having a ceiling, a bottom and a plurality of lateral walls, said walls constituting a structure having a double layer of metal plates, said plates having an insulating material placed therein, the thickness of said insulating material being bigger in said ceiling than in said lateral walls and being bigger in said lateral walls than in said bottom.

3. The system for the protection of luggage as in claim 1, further comprising said oven being built with one only frontal access for inlet and outlet of luggage.

4. The system for protection of luggage as in claim 1, further comprising said oven having two accesses, one access in the front part for an inlet of luggage and another access in the rear part for an outlet of luggage.

5. The system for the protection of luggage as in claim 1, further comprising said conveyor being made by means of a continuous band.

6. The system for the protection of luggage as in claim 5, further comprising said conveyor being movable around two roller pinions for producing the displacement of the luggage.

7. The system for the protection of luggage as in claim 5, further comprising said conveyor being movable by means of several rods.

8. The system for the protection of luggage as in claim 5, further comprising said conveyor being movable by means of several tubular members.

9. The system for the protection of luggage as in claim, 5, further comprising said conveyor having two rack rails in its upper corners, said rack rails engageable with two pinions, said conveyor being driven by a motor reducer.

10. A system for the protection of luggage, based upon the application by thermic effect of a polyethylene retractile material around the luggage in order to obtain external protection against damage produced by improper handling, comprising, in combination, an upright luggage article, said luggage article having a handle on a top edge thereof, an oven, said oven having therein a set of electric resistances to heat the air inside said oven, a fan situated in said oven for moving the air in order to get an homogeneous temperature inside said oven for the retraction of a shrink film plastic bag wrapped around said luggage article; said oven having a ceiling, bottom and lateral walls constituting a double layer of metal plates, between said plates there is placed an insulating material, wherein a thickness of said insulating material and a corresponding distance between said walls being bigger in said ceiling of said oven than in said lateral walls, and in said lateral walls, said insulation being bigger than in said bottom, to accommodate larger heat insulation requirements as heat ascends upward within said oven, said oven having a front entrance part, said front part of said oven being used as entrance and exit of said luggage article, said front part being covered by a flexible curtain made also of an insulating material to avoid loss of temperature inside said oven, whereby the temperature inside said oven is controlled by a thermostat in connection with an electric board to command and control; a mechanism of conveyance for transporting said luggage article in and out of said oven, said mechanism comprising a conveyor for transport of said luggage article, said conveyor movable by two rollers which said rollers are driven by a motor-reducer.

* * * * *